US005492085A

United States Patent [19]

Tiller et al.

[11] Patent Number: 5,492,085

[45] Date of Patent: Feb. 20, 1996

[54] SUPPORTED PUSHROD FOR INTERNAL COMBUSTION ENGINES

[75] Inventors: Tim Tiller, Blue River; Dan Kinsey, LaFarge; Floyd Baker, Viola; George B. Smith, Richland Center, all of Wis.

[73] Assignee: S & S Cycle, Inc., Viola, Wis.

[21] Appl. No.: 354,542

[22] Filed: Dec. 13, 1994

[51] Int. Cl.[6] ..... F01L 1/14

[52] U.S. Cl. ..... 123/90.61; 123/90.35

[58] Field of Search ..... 123/90.61, 90.62, 123/90.63, 90.64, 90.33, 90.35

[56] References Cited

U.S. PATENT DOCUMENTS

| | | | |
|---|---|---|---|
| 1,729,849 | 10/1929 | Willgoos | 123/90.61 |
| 1,823,419 | 9/1931 | Almen | 123/90.61 |
| 2,735,313 | 2/1956 | Dickson | 123/90.61 |
| 3,048,156 | 8/1962 | Slooten | 123/90.61 |
| 3,195,527 | 7/1965 | Eaton | 123/90.61 |
| 3,301,241 | 1/1967 | Iskenderian | 123/90.61 |
| 4,589,384 | 5/1986 | Ott | 123/90.61 |
| 5,095,862 | 3/1992 | Murphy | 123/90.61 |
| 5,154,145 | 10/1992 | Blane | 123/90.61 |

*Primary Examiner*—Weilun Lo

*Attorney, Agent, or Firm*—Foley & Lardner

[57] ABSTRACT

A lightweight pushrod assembly for internal combustion engines, such as motorcycle racing engines, includes a top pushrod and a bottom pushrod which are joined by a pushrod tappet. The pushrod tappet is mounted for reciprocating movement in a pushrod stanchion, and the stanchion is secured to the engine such that support is provided to the pushrod assembly at a position near the middle of the entire pushrod assembly. The pushrod stanchion also provides part of a pushrod housing assembly, with additional upper and lower housings provided to enclose the upper and lower pushrods. The lower end of the top pushrod and the upper end of the bottom pushrod preferably engage the tappet in a ball and socket joint relation to allow limited radial movement of the top and/or bottom pushrods to minimize the stresses on the pushrods. The supported pushrod assembly may be provided in kits for installation of the pushrod assemblies on existing engines.

23 Claims, 4 Drawing Sheets

SUPPORTED PUSHROD FOR INTERNAL COMBUSTION ENGINES

FIELD OF THE INVENTION

This invention pertains generally to the field of components for internal combustion engines, and particularly to pushrods used on internal combustion engines.

BACKGROUND OF THE INVENTION

In internal combustion engines the intake and exhaust valves are actuated by cams, which are designed to lift the valves at precisely the correct instant of piston travel and hold them open long enough to attain the most efficient filling and emptying of the cylinder. In many engine designs the cam activates a pushrod which, in turn, activates a rocker arm which pushes against the end of the valve stem thereby opening the valve. The pushrod, rocker arm, and valve are the primary components of the engine valve train in such engine designs.

A long standing goal of engine design is to produce greater engine power while simultaneously achieving better fuel economy. Engine components of a lighter weight further this goal because lower engine component weight decreases the amount of work necessary for operation, thereby increasing engine efficiency. Heavier valve train components, on the other hand, require more power to move, which reduces the amount of power which the engine is capable of producing and causes more wear on the engine. The mass of the valve train components is also a factor limiting the maximum RPM capability of the engine. Heavier valve trains also require higher valve spring pressures which are needed to hold the valve train in engagement with the cam to follow the cam profile. This higher spring pressure also causes additional wear.

Many engines require, by design, relatively long pushrods. The stresses generated by these engines can cause the rods to flex or bend. This pushrod flex can alter the designed performance of the engine by reducing valve lift and changing the valve timing. Pushrod flex also causes excessive clearance between the pushrod and adjacent engine parts, resulting in high stress and undue wear to the entire valve train. In extreme cases of excessive clearance a pushrod may become disengaged completely, causing severe damage to the engine.

What is desired, therefore, is a pushrod which is both lightweight and capable of maintaining rigidity under the high stresses generated by an engine in order to maintain designed valve operation.

SUMMARY OF THE INVENTION

In accordance with the present invention a lightweight pushrod assembly is supported in the middle to maintain rigidity under the stresses generated by the engine, thereby maintaining designed valve operation. By offering mid-rod support the flex or bend of the supported pushrod assembly is substantially prevented. The elimination of pushrod flex allows the engine to perform as designed by maintaining both proper valve lift and stable and appropriate valve timing. The increased rigidity of the supported pushrod assembly also tolerates higher valve seat and nose pressures. The supported pushrod assembly of the present invention also allows more efficient pushrod angles, reducing side thrust loads on the cam follower tappet and rocker arms, thereby increasing the life of the valve train. This also reduces the likelihood of the rods becoming disengaged during high RPM operation of the engine.

The use of a central support to maintain rigidity also allows the pushrods themselves to be lighter, for example, by making them smaller in diameter, thereby increasing the amount of power which the engine is capable of producing and reducing engine wear.

A supported pushrod assembly in accordance with the present invention preferably includes a top pushrod and a bottom pushrod which are joined at the center of the supported pushrod assembly by a pushrod tappet. At least one of the pushrods is engaged to the pushrod tappet with mating surfaces which allow pivotal movement of the pushrod with respect to the tappet. The pushrod tappet is mounted for reciprocating movement in a pushrod stanchion whose bore diameter is only slightly larger than the outer diameter of the cylindrical pushrod tappet. The pushrod stanchion is, in turn, secured to the engine such that the pushrod tappet/stanchion combination provides mid-rod support to the pushrod assembly. The pushrod stanchion also acts as one part of a pushrod housing assembly which may enclose the pushrod assembly when it is assembled for operation as part of an engine.

For operation, the supported pushrod assembly is installed in an engine between the valve rocker arm and the cam follower tappet. The pushrod tappet rides up and down inside the pushrod stanchion and is lubricated by oil which spills into the pushrod housing assembly from the rocker arm chamber.

The supported pushrod assembly of the present invention is particularly suited for use in pushrod equipped motorcycle engines. The supported pushrod assembly may be pre-installed within an engine as a unit, provided as a kit for installation in an engine with a pre-cast pushrod housing, or provided with the pushrod housing assembly as a kit so that it will be possible to install the supported pushrod assembly on an existing engine. A supported pushrod assembly in accordance with the present invention is both more rigid and lighter than the typical pushrod used in a high performance engine application.

Further objects, features, and advantages of the invention will be apparent from the following detailed description when taken in conjunction with the accompanying drawings.

DETAILED DESCRIPTION OF THE INVENTION

Figure 1:
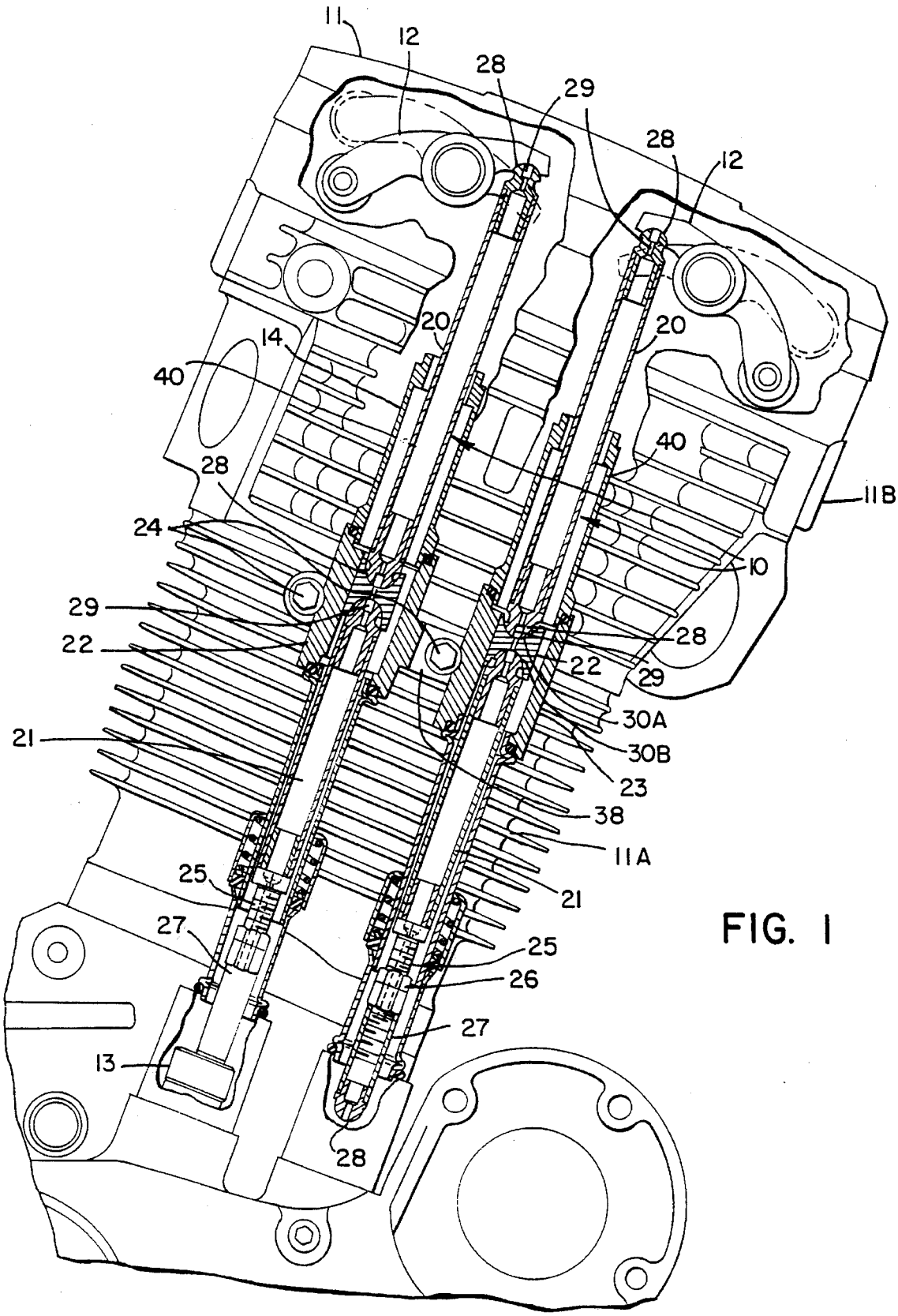
FIG. 1 is a cross-sectional view of supported pushrod assemblies in accordance with the present invention installed adjacent to one cylinder of a motorcycle engine, showing also in partial cross-section the portions of the engine which are adjacent to the pushrod assemblies.

With reference to the drawings, two supported pushrod assembles 10 in accordance with the invention and a portion of the cylinder block 11A and cylinder head 11B of an internal combustion engine 11 are shown in cross-section in FIG. 1. The pushrod assemblies 10 activate rocker arms 12 which, in turn, transmit force to the top surfaces of valve stems (not shown) thereby opening intake and exhaust valves (not shown) in a conventional manner. The pushrods are each activated by a cam follower tappet 13 or lifter which, in turn, is driven by a cam (not shown).

Each supported pushrod assembly 10 includes a top pushrod assembly 20, a bottom pushrod 21, and a pushrod tappet 22 in between the top pushrod 20 and the bottom pushrod 21. The pushrod tappet 22 is enclosed in a pushrod stanchion 23 which is secured to the engine such as by bolts 24 or by being precast on the engine cylinder block 11A or on the cylinder head 11B.

Figure 2:
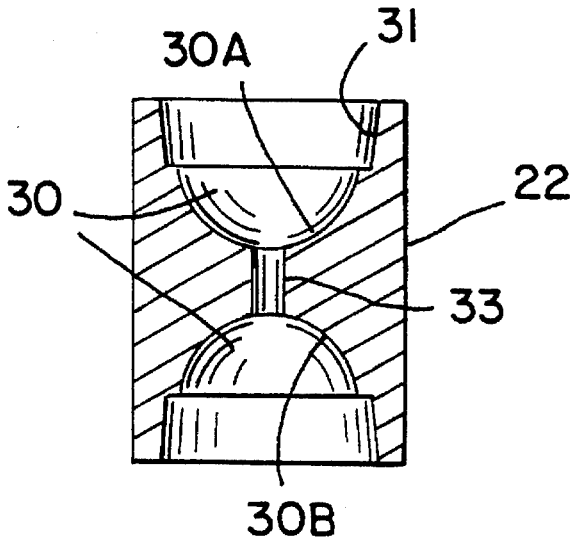
FIG. 2 is a cross-sectional view of a supported pushrod tappet.

The pushrod tappet 22 is shown in detail in the cross-sectional view of FIG. 2. The pushrod tappet 22 is preferably cylindrical in shape. Each end of the pushrod tappet preferably contains a recessed hemispherically shaped depression 30, including an upper depression or socket 30A and a lower depression or socket 30B. The depressions provide seats in which the lower hemispherical end 28 of the top pushrod 20 and the upper hemispherical end 28 of the bottom pushrod 21 will seat. Alternatively, the pushrod tappet 22 may have hemispherical ends, in which case the lower end of the top pushrod 20 and the upper end of the bottom pushrod 21 would have corresponding hemispherical depressions. The hemispherical depressions 30 on the pushrod tappet 22 are preferably recessed from the ends of the pushrod tappet cylinder by apertures 31 having frustoconical walls. The top pushrod 20 and bottom pushrod 21 can thus pivot slightly at their junctions with the pushrod assembly tappet 22. The supported pushrod assembly 10 thereby also allows more efficient pushrod angles, reducing side thrust loads on the cam follower tappet and rocker arms and increasing the life of the valve train.

The walls of the recession apertures 31 are angled, preferably at approximately 12 degrees, to form a funnel which directs oil toward the ball and socket joint formed by the ends 28 of the top and bottom pushrods 20 and 21 and the pushrod tappet depressions 30, thereby lubricating the joint. Preferably, a small aperture 33 is formed axially through the pushrod tappet cylinder 22 from the bottom of one depression 30 to the bottom of the other. The aperture 33 both reduces the weight of the tappet and provides for enhanced flow of oil and air through the tappet and the top and bottom pushrods, cooling the parts and promoting longer part life and better performance. The ends of the top and bottom pushrods also preferably have openings 29 formed therein to allow flow of oil to and from the ball joint formed between the hemispherical ends 28 and the depressions 30.

Figure 3:
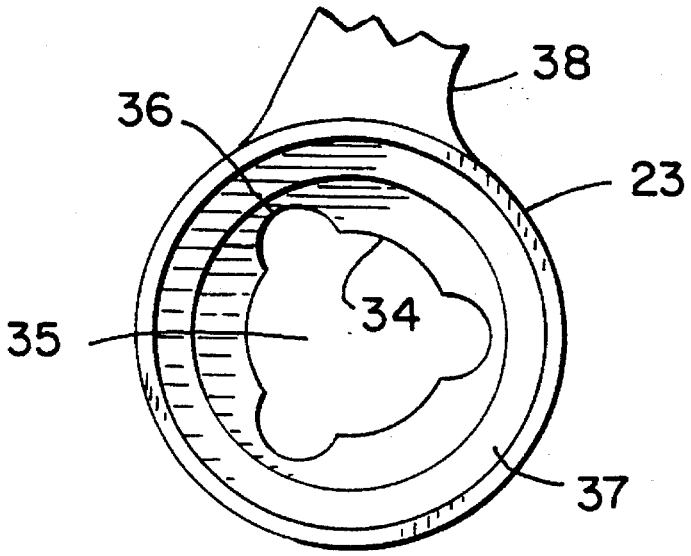
FIG. 3 is a top view of a supported pushrod stanchion.

The pushrod tappet 22 is contained in a pushrod stanchion 23 shown in top view detail in FIG. 3. The pushrod stanchion 23 is basically cylindrical in shape with an inner surface 34 defining a cylindrical aperture 35 running through the center of the pushrod stanchion cylinder. The central aperture 35 in the pushrod stanchion 23 has a diameter only slightly larger than the outer diameter of the pushrod tappet 22. For example, for a pushrod tappet 22 with an outer diameter of 0.5625 inch the pushrod stanchion 23 may have an inner aperture diameter of 0.563 inch. The pushrod stanchion 23 is secured in place to the engine cylinder block for supported pushrod operation. The pushrod stanchion 23 may be secured in various ways, such as by the use of bolts 24 which extend through openings 39 in lugs 38 into threaded holes in the cylinder block 11A (or in the cylinder head 11B). The lugs 38 are preferably integrally cast with the stanchions, as shown in FIGS. 1, 3, 4 and 5. Alternatively, the stanchions may be integrally formed as part of the engine 11 by being cast on the cylinder block 11A or the cylinder head 11B. During operation of the supported pushrod assembly the pushrod tappet 22 is mounted for reciprocating movement in the aperture 35 of the pushrod stanchion 23. The pushrod tappet 22 and pushrod stanchion 23 thus act together to provide mid-rod support to the pushrod assembly.

Lubrication of the pushrod tappet 22 as it reciprocates in the pushrod stanchion 23 is facilitated by oil dripping onto the supported pushrod assembly 10 from adjacent engine parts such as the rocker arm 12 or by oil under pressure forced between the pushrod assembly and adjacent parts. Lubrication flow, and increased air flow to provide cooling to the pushrod tappet 22 and stanchion 23, is preferably facilitated by one or more channels 36 formed along the inner surface 34 of the central aperture 35 of the pushrod stanchion 23, as best shown in FIG. 3. The channels 36 preferably extend the length of the inner surface of the pushrod stanchion 23. Alternatively, lubrication and air flow may be provided by one or more channels (not shown) which may be formed to extend along the outer surface of the pushrod tappet 22 from one end of the tappet 22 to the other.

As illustrated in FIG. 1, the top pushrod 20 and the bottom pushrod 21 are preferably formed as lightweight hollow metal cylinders, e.g., aluminum alloy, with the ends 28 formed of hardened steel. Since the pushrods are centrally supported to eliminate flex, the diameter of the pushrods 20 and 21, as compared to the diameter of unsupported pushrods, may be reduced, and lighter materials may be used. The ends 28 of the pushrods 20 and 21 preferably have small central apertures 29 formed therein which both lighten the weight of the ends and provide a channel for oil to flow from and into the hollow interior of the rods 20 and 21, and which also allow some air flow for additional cooling of the pushrods.

When assembled in place on the engine the upper end 28 of the top pushrod 20 is seated in the valve rocker arm 12, the lower end 28 of the top pushrod 20 is seated in the upper depression 30A on the pushrod tappet 22, the upper end 28 of the bottom pushrod 21 is seated in the lower depression 30B of the pushrod tappet 22, and the lower end 28 of the bottom pushrod 21 is in contact with a cam follower tappet 13 which is in contact with a cam. The components of the supported pushrod assembly are held together by the force exerted by valve springs (not shown) which apply force to the rocker arm 12 to press the supported pushrod components between the rocker arm 12 and the cam follower tappet 13.

As best shown in FIG. 1, the bottom pushrod 21 preferably has an adjustable end section 27 which allows use of the same supported pushrod assembly 10 in applications where pushrods of slightly varying length are required. The adjustable bottom pushrod 21 preferably includes a threaded bolt 25, a lock nut 26 which is threaded onto the bolt 25, with the pushrod end section 27 having a threaded aperture at one end which threads onto the bolt 25, and a hemispherical end 28 which forms the bottom end of the pushrod and is engaged to the cam follower tappet 13. A small aperture is preferably provided running axially along the center of the bolt 25 and through the center of the hemispherical pushrod end 28 in order to provide a channel for lubricant and air flow to cool the supported pushrod assembly 10. The length of the supported pushrod assembly 10 is adjusted by varying the position of the adjustable pushrod end section 27 along the adjustment bolt 25 and securing the adjustable pushrod end section 27 in its desired position by use of the lock nut 26. Such adjustable sections 27 have been used in conventional pushrods and their construction and use are well known.

Figure 4:
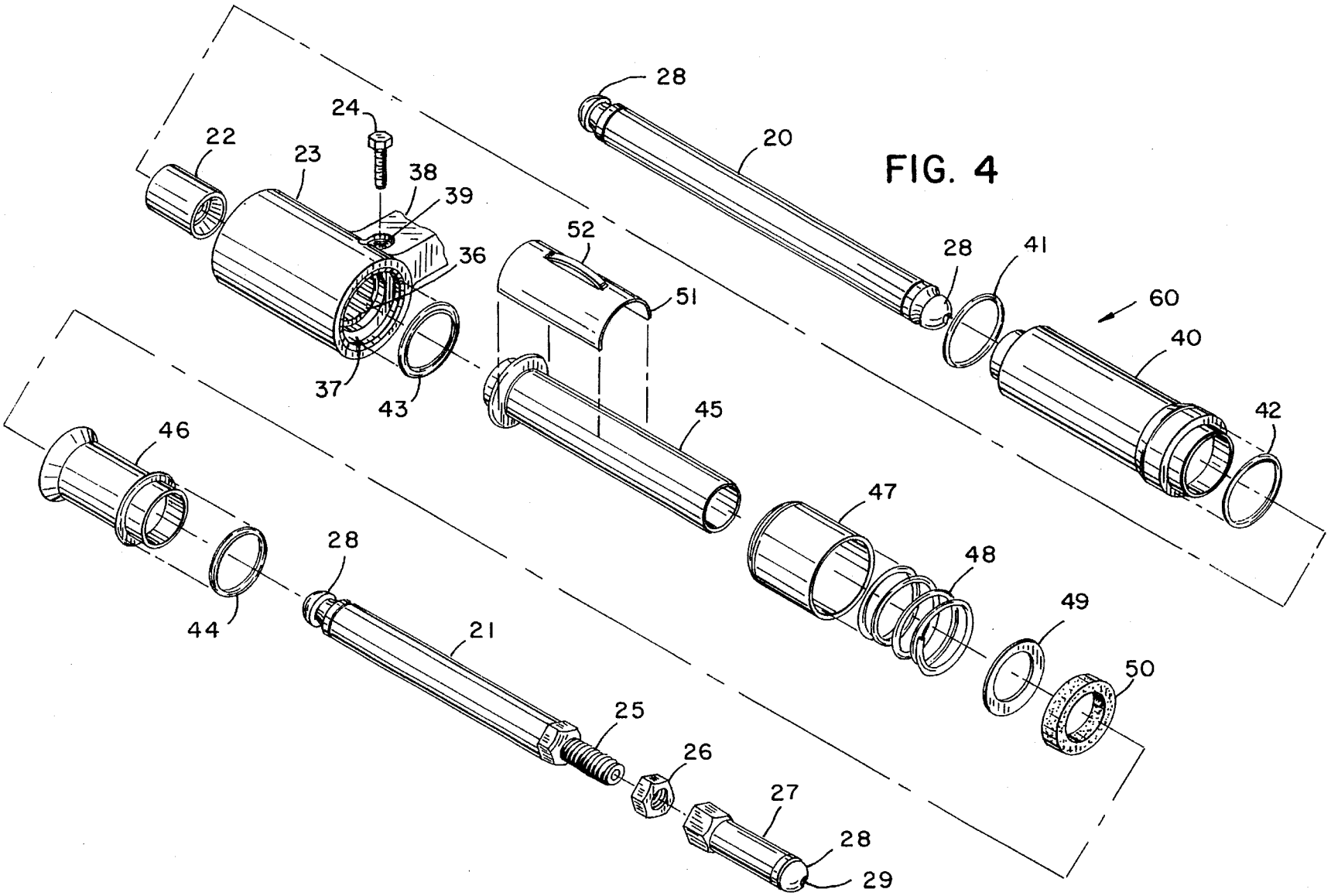
FIG. 4 is an exploded perspective view of a supported pushrod assembly and pushrod assembly housing assembly in accordance with the present invention.
Figure 5:
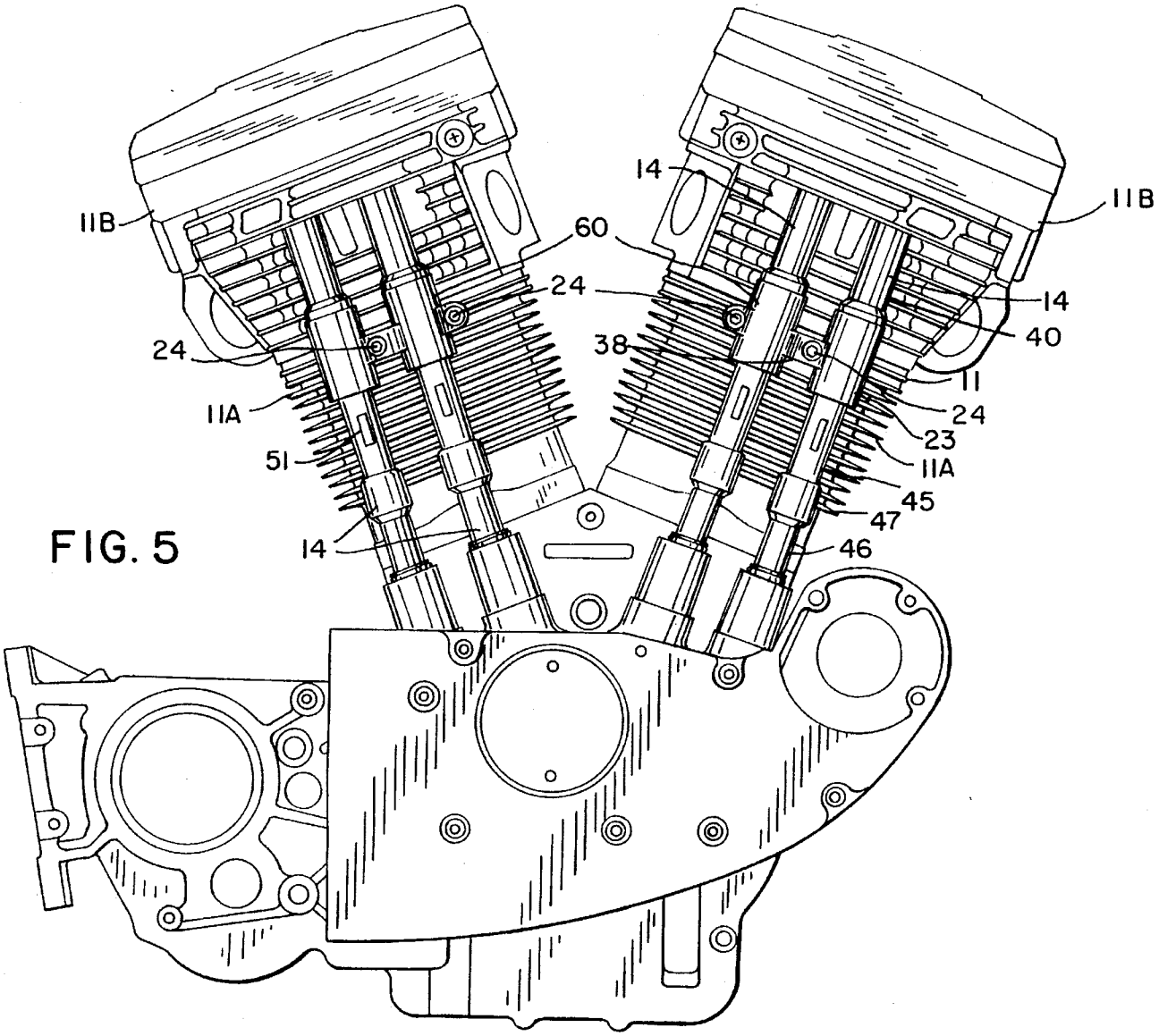
FIG. 5 is a side view of a motorcycle engine showing two pairs of supported pushrod assemblies in accordance with the invention which are enclosed in pushrod housing assemblies attached to the outside of the cylinder block of the motorcycle engine.

In operation, the entire supported pushrod assembly 10 is preferably enclosed in a pushrod housing assembly 14, as illustrated in FIGS. 1 and 5. Oil flowing within the housing assembly serves to lubricate the pushrod tappet. The housing assembly 14 may be pre-cast in the engine cylinder block (or cylinder head) or may be formed as separate parts provided with the supported pushrod to form a pushrod assembly kit. The components of this assembly kit are shown in an exploded view in FIG. 4. The components of either the supported pushrod assembly itself or the entire assembly kit may be provided as a kit so that the supported pushrod assembly 10, or the supported pushrod assembly 10 and pushrod housing assembly 14, can be assembled on an existing engine. The preferred components of the supported pushrod assembly kit are those described above: a top pushrod 20, a pushrod tappet 22, a pushrod stanchion 23, and a bottom pushrod 21 (which, for an adjustable pushrod, includes an adjustment bolt 25, a lock nut 26, and an adjustable pushrod end section 27). The pushrod housing assembly 14 may be formed of a hollow tube (or tubes) which encloses the top and bottom pushrods 20 and 21 and seals the openings to the engine chambers containing the rocker arm 12 and the cam follower tappet 13. A top pushrod housing 40 is preferably formed of a hollow cylindrical tube of metal (e.g., aluminum, stainless steel, chrome plated steel, etc.) which sits between the opening to the engine rocker arm 12 chamber and the pushrod stanchion 23. The upper end of the top pushrod housing 40 is shaped to fit the opening to the rocker arm 12 chamber, and a rubber washer 41 is used to seal the connection between the housing and the chamber. The lower end of the top pushrod housing 40 is shaped to fit into a counterbore 37 having a shoulder against which the lower end of the housing is engaged (see FIGS. 3 and 4) at the top end of the pushrod stanchion 23. This junction is also sealed by a rubber washer 42.

The bottom pushrod housing is also preferably a hollow cylinder which is shaped at one end to fit into a counterbore on the lower end of the pushrod stanchion 23. This junction is sealed by a rubber washer or 0-ring 43. The other end of the bottom pushrod housing is shaped to fit the opening to the engine chamber containing the cam follower tappet 13. This junction is also sealed by a rubber washer (O-ring) 44.

To enable a single pushrod housing assembly 14 to be used with different engines having variations in the distance between the opening to the rocker arm 12 and cam follower tappet 13 chambers, an adjustable pushrod housing assembly is preferred. This is preferably accomplished by utilizing an adjustable pushrod housing assembly, as best illustrated in FIG. 4. The adjustable pushrod housing assembly contains an upper housing section 45 and a lower housing section 46 which are both basically hollow cylinders. The upper end of the upper housing section 45 fits against the rubber washer 43 which sits in the counterbore 37 at the lower end of the pushrod stanchion 23. The lower housing section 46 is sealed at its lower end by a rubber washer 44 to the chamber containing the cam follower tappet 13. The lower housing section 46 is connected to the upper housing section 45 by an adjustment assembly which is preferably mounted on the upper housing section 45. The adjustment assembly preferably includes an adjustment collar 47, a compression spring 48, a metal washer 49, a rubber washer 50, and an adjustment collar stop 51. The adjustment collar 47 is in the shape of a hollow cylinder whose inner diameter is wider than the outer diameter of the upper housing 45. One end of the adjustment collar 47 is partially closed to form an annular seat so that the orifice at the upper end of the adjustment collar 47 is smaller than that at the lower end of the adjustment collar 47. The adjustment collar 47 slides over the lower end of the upper pushrod housing 45. It is prevented from sliding all the way up the upper adjustable housing 45 by the adjustment collar stop 51 which fits partially around the upper adjustable housing 45 and sits between one end of that housing 45 and the annular seat at the partially closed end of the adjustment collar 47. The compression spring 48, metal washer 49, and rubber washer 50 sit inside the adjustment collar 47 and around the outside of the upper adjustable housing 45 with the spring seated on the inside of the annular seat at the partially closed end of the adjustment collar. The lower adjustable housing assembly 46 is joined at its upper end to the adjustment assembly (and the upper housing 45) at the rubber washer 50. The length of the pushrod housing assembly is adjusted by compression of the spring 48. The compression spring 48 also applies pressure to the lower adjustable housing 46, securing it in place between the upper housing 45 and the opening to the cam follower tappet chamber.

When the adjustment collar stop 51 is removed, the adjustment collar 47 may slide up the upper adjustment housing 45, thereby relieving pressure on the spring 48. The adjustment collar stop 51 preferably includes a raised handle 52 to facilitate removal. The lower adjustable housing 46 may then also be slid up the upper adjustable housing 45, thereby revealing the lower portion of the bottom pushrod 21 and allowing access to the lock nut 26 and the adjustable pushrod end 27 for adjusting the length of the supported pushrod.

FIG. 5 shows a portion of a two cylinder motorcycle engine with assembled supported pushrod assemblies 60 in place. The supported pushrod assemblies 10 are contained inside the pushrod housing assembly 14 whose various components are visible in FIG. 5. Since each cylinder has two valves, requiring two pushrod assemblies 10, it is preferable that a supported pushrod assembly kit contain two complete supported pushrod assemblies 10 or two complete supported pushrod assemblies 10 with housing assemblies 14. In many applications the two pushrod assemblies for each cylinder will be located close together so that the two pushrod stanchions 23 may be formed into one piece comprising two pushrod stanchions connected together by a lug 38 with bolt holes 39 whereby the subassembly may be secured with bolts 24 to the outside of the engine cylinder block 11A or the cylinder head 11B.

It is understood that the invention is not confined to the particular construction and arrangement of parts herein illustrated and described, but embraces such modified forms thereof as come within the scope of the following claims.

What is claimed is:

1. A supported pushrod assembly for an internal combustion engine comprising:

(a) a top pushrod having an upper end and a lower end;

(b) a bottom pushrod having an upper end and a lower end;

(c) a cylindrical pushrod tappet having a cylindrical outer surface and an upper end and a lower end, wherein the upper end of the pushrod tappet is engaged to the lower end of the top pushrod and the upper end of the bottom pushrod is engaged to the lower end of the pushrod tappet, at least one of the top and bottom pushrods being engaged to the pushrod tappet with mating surfaces which are formed on the pushrod and tappet which allow pivotal movement of the pushrod with respect to the tappet; and (d) a pushrod stanchion to be secured to the engine with two ends and an inner surface and an outer surface, the inner surface defining an aperture in which the pushrod tappet is mounted for reciprocating movement, the inner surface also restricting movement of the pushrod tappet in directions perpendicular to the reciprocating movement, the pushrod stanchion enclosing the pushrod tappet and having a length between the two ends of the stanchion which is less than one half the length of either of the top or bottom pushrods.

2. The supported pushrod assembly of claim 1 wherein the ends of the top and bottom pushrods and the ends of the pushrod tappet are engaged to one another by ball and socket joints.

3. The supported pushrod assembly of claim 1 including means for adjusting the length of the supported pushrod assembly.

4. The supported pushrod assembly of claim 3 wherein the means for adjusting the length of the supported pushrod assembly includes a lower end section of the bottom pushrod threadingly engaged to a bolt extending from a main section of the bottom pushrod and a stop nut on the bolt to secure the lower end section.

5. The supported pushrod assembly of claim 1 wherein the pushrod stanchion has at least one groove on the inner surface extending from one end of the pushrod stanchion to the other end of the pushrod stanchion for cooling and lubrication of the pushrod stanchion and the pushrod tappet.

6. The supported pushrod assembly of claim 1 wherein the stanchion is formed as a separate unit and including means for mounting the stanchion on a cylinder block.

7. A supported pushrod assembly for an internal combustion engine comprising:

(a) a top pushrod having an upper end and a lower end;

(b) a bottom pushrod having an upper end and a lower end;

(c) a cylindrical pushrod tappet having an outer surface and an upper end and a lower end, wherein the upper end of the pushrod tappet is engaged to the lower end of the top pushrod and the upper end of the bottom pushrod is engaged to the lower end of the pushrod tappet, at least one of the top and bottom pushrods being engaged to the pushrod tappet with mating surfaces which are formed on the pushrod and tappet which allow pivotal movement of the pushrod with respect to the tappet; and (d) a pushrod stanchion to be secured to the engine with two ends and an inner surface and an outer surface, the inner surface defining an aperture in which the pushrod tappet is mounted for reciprocating movement, the inner surface also restricting movement of the pushrod tappet in directions perpendicular to the reciprocating movement; and (e) a pushrod housing assembly comprising a top pushrod housing to enclose the top pushrod and having an upper end adapted to engage the engine via a seal and a lower end which engages the upper end of the pushrod stanchion by a seal, and a bottom pushrod housing to enclose the bottom pushrod and having an upper end which engages the lower end of the pushrod stanchion by a seal and a lower end adapted to engage the engine via a seal.

8. The supported pushrod assembly of claim 7 wherein the bottom pushrod housing includes means for adjusting the length of the housing assembly.

9. A supported pushrod assembly for an internal combustion engine comprising:

(a) a top pushrod having an upper end and a lower end;

(b) bottom pushrod having an upper end and a lower end;

(c) a cylindrical pushrod tappet having a cylindrical outer surface and an upper end and a lower end, wherein the upper end of the pushrod tappet lower end of the top pushrod and the upper end of the bottom pushrod is engaged to the lower end of the pushrod tappet, the top and bottom pushrods being engaged to the pushrod tappet with mating surfaces which are formed on the pushrod and tappet which allow pivotal movement of the pushrod with respect to the tappet wherein the bottom end of the top pushrod and the top end of the bottom pushrod have hemispherical surfaces formed thereon and the tappet has an upper hemispherical depression therein which mates with the hemispherical lower end surface of the top pushrod and a lower hemispherical depression therein which mates with the hemispherical upper end surface of the bottom pushrod; and (d) a pushrod stanchion to be secured to the engine with two ends and an inner surface and an outer surface, the inner surface defining an aperture in which the pushrod tappet is mounted for reciprocating movement, the inner surface also restricting movement of the pushrod tappet in directions perpendicular to the reciprocating movement, the pushrod stanchion enclosing the pushrod tappet and not enclosing a substantial portion of each of the top pushrod and the bottom pushrod.

10. The supported pushrod assembly of claim 9 wherein the pushrod tappet has a channel extending therethrough from the upper depression to the lower depression to allow oil to flow therethrough.

11. The supported pushrod assembly of claim 9 wherein an angled wall is formed on each end of the pushrod tappet adjacent to each hemispherical depression thereby to funnel oil into the depression.

12. The supported pushrod assembly of claim 9 wherein the top and bottom pushrods are formed of hollow cylinders and wherein each hemispherical end of the top and bottom pushrod has an aperture therein to allow air and oil flow to and from the hollow interior of the top and bottom pushrods.

13. A supported pushrod assembly kit for an internal combustion engine comprising: a top pushrod with two ends, a bottom pushrod with two ends, a cylindrical pushrod tappet with a cylindrical outer surface and two ends, the two ends of the tappet formed to mate with one end of the top and bottom pushrods and, a pushrod stanchion to be secured to the engine with two ends and an inner surface and an outer surface, the inner surface defining an aperture suitable for mounting the pushrod tappet for reciprocating movement, the inner surface also restricting movement of the pushrod tappet in directions perpendicular to the reciprocating movement, the pushrod stanchion enclosing the pushrod tappet and having a length between the two ends of the stanchion which is less than one half the length of either of the top or bottom pushrods.

14. The supported pushrod assembly kit of claim 13 wherein the ends of the pushrod tappet are recessed hemispherical surfaces and the pushrod tappet has a channel extending therethrough from the upper recessed hemispherical surface to the lower recessed hemispherical surface to allow oil to flow therethrough.

15. The supported pushrod assembly kit of claim 13 including means for adjusting the length of the bottom pushrod.

16. The supported pushrod assembly kit of claim 13 wherein the pushrod stanchion has an upper end and a lower end and including means for securing the pushrod stanchion to the engine.

17. The supported pushrod assembly kit of claim 13 wherein the top and bottom pushrods are formed of hollow cylinders and wherein each end of the top and bottom pushrod is hemispherical and has an aperture therein to allow air and oil flow to and from the hollow interior of the top and bottom pushrods.

18. The supported pushrod assembly kit of claim 16 wherein the pushrod stanchion has at least one groove on the inner surface extending from one end of the pushrod stanchion to the other end of the pushrod stanchion for cooling and lubrication of the pushrod stanchion and pushrod tappet.

19. The supported pushrod assembly kit of claim 16 including means for adjusting the length of the bottom pushrod housing.

20. The supported pushrod assembly kit of claim 13 wherein the kit includes two top pushrods, two bottom pushrods, and two pushrod tappets.

21. The supported pushrod assembly kit of claim 20 wherein the pushrod stanchion is a pushrod stanchion subassembly comprising two pushrod stanchions connected together having an upper end and a lower end and including means for securing the pushrod stanchion subassembly to the engine, and additionally comprising two top pushrod housings each having an upper end and a lower end to enclose the two top pushrods, two rubber washers to seal the upper ends of the two top pushrod housings when mated to the engine, two rubber washers to seal the lower ends of the top pushrod housings when mated to the upper end of the pushrod stanchion subassembly, two bottom pushrod housings to enclose the bottom pushrods and each having an upper end and a lower end, two rubber washers to seal the upper ends of the bottom pushrod housings when mated to the lower end of the pushrod stanchion subassembly, and two rubber washers to seal the lower ends of the bottom pushrod housings when mated to the engine.

22. A supported pushrod assembly kit for an internal combustion engine comprising: a top pushrod with two ends, a bottom pushrod with two ends, a cylindrical pushrod tappet with a cylindrical outer surface and two end, the two ends of the tappet formed to mate with one end of the top and bottom pushrods, and a pushrod stanchion to be secured to the engine with two ends and an inner surface and an outer surface the inner surface defining an aperture suitable for mounting the pushrod tappet for reciprocating movement, the inner surface also restricting movement of the pushrod tappet in directions perpendicular to the reciprocating movement, wherein the ends of the top pushrod and the ends of the bottom pushrod are hemispherical surfaces and the ends of the pushrod tappet are recessed hemispherical depressions to engage one end of the top pushrod and one end of the bottom pushrod in a ball and socket joint relation and to allow the top pushrod and bottom pushrod a small degree of pivotal movement with respect to the axis of the pushrod tappet, the pushrod stanchion enclosing the pushrod tappet and not enclosing a substantial portion of each of the top pushrod and the bottom pushrod.

23. A supported pushrod assembly kit for an internal combustion engine comprising: a rod pushrod with two ends, a bottom pushrod with two ends, a cylindrical pushrod tappet with a cylindrical outer surface and two ends, the two ends of the tappet formed to mate with one end of the rod and bottom pushrods and, a pushrod stanchion to be secured to the engine with two ends and an inner surface and an outer surface, the inner surface defining an aperture suitable for mounting the pushrod tappet for reciprocating movement, the inner surface also restricting movement of the pushrod tappet in directions perpendicular to the reciprocating movement, a top pushrod housing having an upper end and a lower end to enclose the top pushrod, a rubber washer to seal the upper end of the top pushrod housing when mated to the engine, a rubber washer to seal the lower end of the top pushrod housing when mated to the upper end of the pushrod stanchion, a bottom housing with an upper end and a lower end to enclose the bottom pushrod, a rubber washer to seal the upper end of the bottom pushrod housing when mated to the lower end of the pushrod stanchion, and a rubber washer to seal the lower end of the bottom pushrod housing when mated to the engine.

* * * * *

UNITED STATES PATENT AND TRADEMARK OFFICE

CERTIFICATE OF CORRECTION

PATENT NO. : 5,492,085

DATED : February 20, 1996

INVENTOR(S) : Tim Tiller, et al.

It is certified that error appears in the above-indentified patent and that said Letters Patent is hereby corrected as shown below:

In column 2, line 56 of the patent, "pushrod assembly housing assembly" should be --pushrod housing assembly-- as written in the application on page 4, line 22.

In column 2, line 67 of the patent, "assembles" should be --assemblies-- as per Amendment dated June 23, 1995.

In column 3, line 6 of the patent, "pushrods" should be --pushrod assemblies-- as per Amendment dated June 23, 1995.

In column 3, line 10 of the patent, "pushrod assembly 20" should be --pushrod 20-- as per Amendment dated June 23, 1995.

In column 6, line 38 of the patent, "assembly 14" should be --assemblies 14-- as per Amendment dated June 23, 1995.

In column 8, line 10 of the patent, --is engaged to the-- should be inserted after "pushrod tappet" as per Supplemental Amendment dated August 31, 1995.

UNITED STATES PATENT AND TRADEMARK OFFICE

CERTIFICATE OF CORRECTION

PATENT NO. : 5,492,085

DATED : February 20, 1996

INVENTOR(S) : Tim Tiller, et al.

It is certified that error appears in the above-indentified patent and that said Letters Patent is hereby corrected as shown below:

In column 10, line 5 of the patent, "surface the" should be --surface, the-- as per Supplemental Amendment dated August 31, 1995.

In column 10, line 25 of the patent, "end of the rod" should be --end of the top-- as per Supplemental Amendment dated August 31, 1995.

Signed and Sealed this

Third Day of September, 1996

*Attest:*

Bruce Lehman

BRUCE LEHMAN

*Attesting Officer*

*Commissioner of Patents and Trademarks*